US009637998B2

(12) United States Patent
Allensworth et al.

(10) Patent No.: US 9,637,998 B2
(45) **Date of Patent: *May 2, 2017**

(54) SUBSEA SAFETY VALVE SYSTEM

(71) Applicant: Schlumberger Technology Corporation, Sugar Land, TX (US)

(72) Inventors: David Carter Allensworth, Pearland, TX (US); Josh Rayner, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/809,632

(22) Filed: Jul. 27, 2015

(65) Prior Publication Data

US 2016/0024880 A1 Jan. 28, 2016

Related U.S. Application Data

(63) Continuation of application No. 13/484,683, filed on May 31, 2012, now Pat. No. 9,091,136.

(Continued)

(51) Int. Cl.
*E21B 34/04* (2006.01)
*E21B 34/06* (2006.01)

(Continued)

(52) U.S. Cl.
CPC ..... *E21B 34/04* (2013.01); *E21B 29/12* (2013.01); *E21B 34/045* (2013.01);

(Continued)

(58) Field of Classification Search
CPC ..... E21B 34/045; E21B 34/063; E21B 34/10; E21B 34/16; E21B 34/04; E21B 29/12; E21B 41/0007

(Continued)

(56) References Cited

U.S. PATENT DOCUMENTS 4,126,183 A 11/1978 Walker
4,361,165 A * 11/1982 Flory ..... F16K 17/40 137/614.02

(Continued)

FOREIGN PATENT DOCUMENTS

WO 2004055316 7/2004

OTHER PUBLICATIONS

EP Appln No. 12792094.0, Extended European Search Report, dated Jun. 29, 2015, 6 pgs.

(Continued)

*Primary Examiner* — Matthew R Buck
(74) *Attorney, Agent, or Firm* — Tuesday Kaasch

(57) ABSTRACT

A valve system for ensuring well closure upon exposure to a predetermined condition even where a well access line is disposed through the valve. This system may be configured with a supplemental power supply capable of effectuating a cutting closure of the valve. Thus, any obstructing well access line such as coiled tubing may be cut during closure to ensure sealing off of the well, even if the cutting mechanism is separated from its traditional power supply by shear or parting of a portion of the landing string. Once more, the supplemental power sufficient for a cutting closure is only provided in the event of a predetermined condition such as the emergence of a potentially hazardous tubular separation.

19 Claims, 5 Drawing Sheets

Related U.S. Application Data

(60) Provisional application No. 61/492,713, filed on Jun. 2, 2011.

(51) Int. Cl.
*E21B 34/10* (2006.01)
*E21B 34/16* (2006.01)
*E21B 29/12* (2006.01)
*E21B 41/00* (2006.01)

(52) U.S. Cl.
CPC ..... *E21B 34/063* (2013.01); *E21B 34/10* (2013.01); *E21B 34/16* (2013.01); *E21B 41/0007* (2013.01)

(58) Field of Classification Search
USPC ..... 166/363, 361, 364, 365, 297, 373
See application file for complete search history.

(56) References Cited

U.S. PATENT DOCUMENTS 4,494,609 A * 1/1985 Schwendemann ..... E21B 17/06 166/322
5,284,209 A * 2/1994 Godfrey ..... E21B 29/04 166/336
5,771,974 A * 6/1998 Stewart ..... E21B 34/045 166/322
6,425,443 B1 * 7/2002 Hill ..... E21B 17/06 166/242.6
6,450,541 B1 * 9/2002 Bakke ..... E21B 17/06 285/2
7,100,696 B2 * 9/2006 Marshall ..... E21B 31/00 166/242.6
7,624,792 B2 * 12/2009 Wright ..... E21B 33/06 137/68.11
7,849,926 B2 * 12/2010 Inderberg ..... E21B 17/06 137/68.14
8,555,981 B2 * 10/2013 Edwards ..... E21B 17/06 166/365
9,091,136 B2 * 7/2015 Allensworth ..... E21B 34/063
2002/0066557 A1 * 6/2002 Hamilton ..... E21B 23/00 166/75.14
2004/0003926 A1 * 1/2004 Nivens ..... E21B 34/12 166/340
2009/0321088 A1 * 12/2009 Wright ..... E21B 33/06 166/386
2010/0051847 A1 * 3/2010 Mailand ..... E21B 29/04 251/288
2011/0005770 A1 1/2011 Scranton

OTHER PUBLICATIONS

PCT/US2012/040378, International Search Report and Written Opinion, dated Dec. 14, 2012, 11 pgs.

* cited by examiner

SUBSEA SAFETY VALVE SYSTEM

PRIORITY CLAIM/CROSS REFERENCE TO RELATED APPLICATION(S)

This Patent Document claims priority under 35 U.S.C. §119 to U.S. Provisional App. Ser. No. 61/492,713, filed on Jun. 2, 2011, and entitled, "A Method for Failsafe Subsea Safety Valve Actuation", and U.S. patent application Ser. No. 13/484,683, filed on May 31, 2012, and entitled "Subsea Safety Valve System", each of which are incorporated herein by reference in their entirety.

BACKGROUND

Exploring, drilling, completing, and operating hydrocarbon and other wells are generally complicated, time consuming and ultimately very expensive endeavors. In recognition of these expenses, added emphasis has been placed on well access, monitoring and management throughout the productive life of the well. That is to say, from a cost standpoint, an increased focus on ready access to well information and/or more efficient interventions have played roles in maximizing overall returns from the completed well.

By the same token, added emphasis on operator safety may also play a role in maximizing returns. For example, ensuring safety over the course of various offshore operations may also ultimately improve returns. As such, a blowout preventor (BOP), subsurface safety valve and other safety features are generally incorporated into hardware of the well head at the seabed. Thus, production and pressure related hazards may be dealt with at a safe location several hundred feet away from the offshore platform.

In most offshore circumstances, the noted hardware of the well head and other equipment is disposed within a tubular riser which provides cased access up to the offshore platform. Indeed, other lines and tubulars may run within the riser between the noted seabed equipment and the platform. For example, a landing string which provides well access to the newly drilled well below the well head will run within the riser along with a variety of hydraulic and other umbilicals.

One safety measure that may be incorporated into the landing string is a particularly tailored and located weakpoint. The weakpoint may be located in the vicinity of the BOP, uphole of the noted safety valve. Therefore, where excessive heave or movement of the offshore platform translates to excessive stress on the string, the string may be allowed to shear or break at the weakpoint. Thus, an uncontrolled breaking or cracking at an unknown location of the string may be avoided. Instead, a break at a known location may take place followed by directed closing of the safety valve therebelow. As a result, an unmitigated hazardous flow of hydrocarbon through the riser and to the platform floor may be avoided.

Unfortunately, the closing of the safety valve in conjunction with the separation of the tubular thereabove is not always readily attainable. For example, in certain situations, coiled tubing, wireline or other interventional access line may be disposed through the valve at the time the above tubular separation occurs. When this is the case, the valve may be obstructed and unable to close. Thus, hydrocarbons may continue to leak past the valve and travel up the annulus of the riser to the platform with potentially catastrophic consequences.

In order to prevent such hazardous obstructions, the valve may be configured to achieve a cut-through of any interventional access line in combination with closure. So, for example, an internal spring or other valve closure mechanism may be utilized which employs enough force to ensure a cut-through of any obstruction each time that the valve closes.

Unfortunately, utilizing enough force to both close the safety valve and provide any necessary cutting, upon each valve closure may impair routine operation of the valve. That is to say, opening, closing and re-opening of the valve may be routinely desirable throughout the life of the well. For example, this may include opening the valve for production, closing the valve to halt production, and re-opening the valve for the sake of well killing. Whatever the case, if the valve has been closed with force sufficient to achieve cutting, subsequent re-opening of the valve may be a challenge. In the noted well killing example, the introduction of kill fluid at 1,000-1,500 PSI may no longer be sufficient to attain valve re-opening. Rather, several thousand PSI may be required. This is particularly inefficient given the remote likelihood of any need for actual cutting during valve closure.

Given the inefficiencies of closing the safety valve with sufficient cutting force upon each and every valve closure, alternative safety measures are generally employed where offshore intervention is sought. For example, an operator will generally ensure that offshore interventions are undertaken for shorter durations and in calmer weather conditions. Thus, the chance of a tubular separation is reduced, particularly with an obstructing access line at the safety valve. Of course, weather based operations may result in downtime and/or delays. By the same token, shorter intervention trips in the well may lead to a greater number of trips. Nevertheless, as a practical matter, such precautionary measures are generally utilized, particularly in shallower offshore environments where tubular separations may be more likely. As a result, offshore interventional costs may become quite excessive.

SUMMARY

A subsea safety valve system is described. The system includes a safety valve for governing well access which is in hydraulic communication with an accumulator. A tubular is coupled to the valve and outfitted with a region which may separate upon a predetermined event. Additionally, a relay mechanism is provided that is coupled to the accumulator and also configured to detect the noted separation so as to trigger a closing of the valve. In one embodiment, the system further includes an interventional access line running through the valve which may be cut during the indicated closing of the valve.

Of course, this summary is provided to introduce a selection of concepts that are further described below and is not intended as an aid in limiting the scope of the claimed subject matter.

DETAILED DESCRIPTION

Embodiments are described with reference to certain types of subsea blowout isolation assemblies and operations. For example, the assemblies are depicted utilizing a separable transmission line and the operations involved include coiled tubing operations. However, alternate types of communications and interventional operations may be involved. For example, the assembly may be directed at accommodating a wireline cable therethrough as opposed to coiled tubing. Regardless, embodiments of the assembly include a power source and transmission or relay mechanism which are both located below a separation point of a subsea tubular linked thereto. Thus, upon tubular separation, automatic signaling and sufficient power for a cutting closure of a valve of the assembly may be provided so as to simultaneously sever the interventional line and seal the valve closed.

Figure 1:
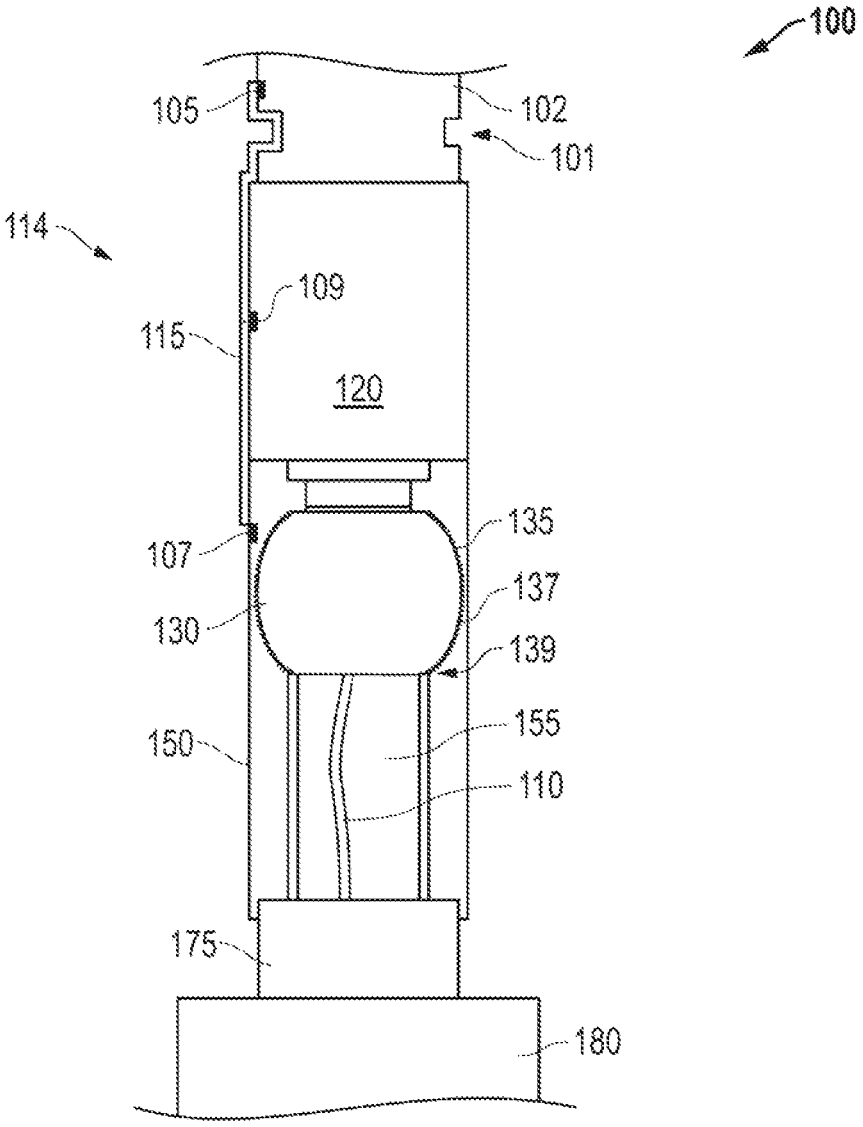
FIG. 1 is a side schematic sectional view of an embodiment of a subsea blowout isolation assembly.

Referring now to FIG. 1, a side schematic sectional view of an embodiment of a subsea blowout isolation assembly 100 is shown. With added reference to FIG. 2, the assembly 100 represents the terminal end of blowout preventer equipment for a landing string, such as may be disposed through a riser 250 for offshore operations. More specifically, the assembly 100 terminates at a coupling 175 which is anchored to any additional pressure control equipment 180, which is in turn disposed at a well head 279. Thus, access to a subsea well 280 may be securely attained. As such, additional completions, flow testing and/or a variety of interventions as referenced below may proceed in a controllable manner.

Continuing with reference to FIG. 1, the blowout isolation assembly 100 provides the noted well access by way of a central channel 155. As a matter of safety, the assembly 100 is equipped with a valve segment 150 for governing fluid flow in the channel 155 at the location of the assembly 100. More specifically, this segment 150 of the assembly 100 includes a valve 130 which may be open or closed so as to govern fluid flow at this portion of the channel 155. In the embodiment shown, the valve 130 is a ball valve 130 in an open position, for example, as to allow fluid production from the well 280 of FIG. 2.

Figure 2:
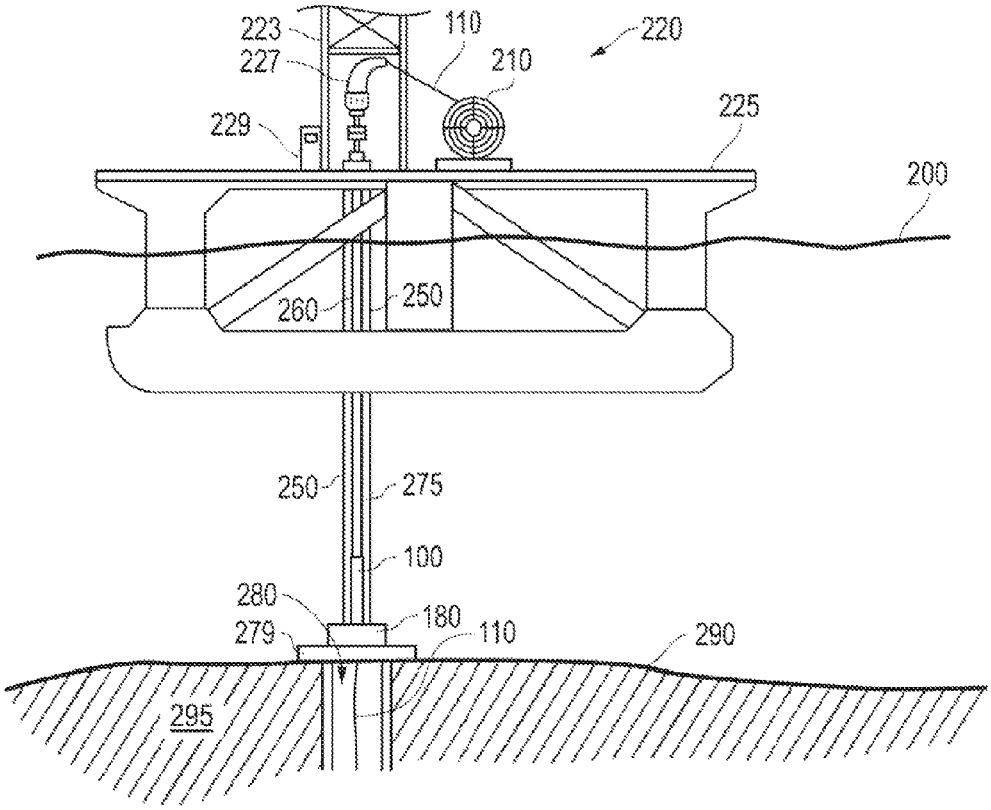
FIG. 2 is an overview of an embodiment of a subsea oilfield employing the assembly of FIG. 1 over a well at a seabed.

In addition to produced fluids from the well 280, the open valve 130 may allow for a host of different fluids or tools to be advanced past the assembly 100 to a subsea well 280, for example, from an offshore platform 220 as shown in FIG. 2. Indeed, in the embodiment of FIG. 1, a well access line in the form of coiled tubing 110 is depicted traversing the valve 130 and channel 155 of the assembly 100 so as to access the subsea well 280 (see FIG. 2).

Continuing with reference to FIGS. 1 and 2, the assembly 100 constitutes the terminal end of a tubular string 260 which is deployed through a riser 250 as alluded to above. The riser 250 provides a stable conduit between the offshore platform 220 and the well head 279 at the seabed 290. Thus, the string 260 may securely provide the internal conduit for transport of fluids, tools, access lines and such between the platform 220 and the well 280. For example, with particular reference to FIG. 2, coiled tubing 110 is shown deployed from the platform 220 and ultimately reaching the well 280 via the tubular string 260.

In certain circumstances, however, increased stress may be directed at the assembly 100. For example, current of the water 200 or heave of the platform 220 in one direction or another relative the well head 279 may translate an increased amount of stress to the assembly 100. Thus, with particular focus on FIG. 1, the assembly 100 is outfitted with a separation segment 102. In the embodiment shown, the separation segment 102 includes a shearing joint 101 to allow for an intentional breaking or separation of the segment 102 at that location once a predetermined amount of load or stress is encountered. In this manner, it may be assured that the shearing or separation of the assembly 100 takes place at a location above the valve segment 150. As such, an automatic triggering of the valve 130 to a closed position may occur so as to seal off the well 280 therebelow (see FIG. 4B). In other embodiments, however, the separation segment 102 may merely constitute the upper tubular region of the assembly 100 which is prone to shearing under appropriate conditions, irrespective of the presence of any shearing joint 101.

Continuing with reference to FIGS. 1 and 2, the assembly 100 is configured to allow for a line, such as wireline or coiled tubing 110 to pass through the open valve 130 as described above. However, once the valve 130 is triggered to close in the event of the above described separation, such a line may present an obstruction to safe closure. Thus, embodiments detailed herein are configured to allow for a triggered closure of the valve 130 with enough force so as to simultaneously cut an otherwise obstructing line such as the depicted coiled tubing 110. Indeed, the outer surface 135 of the ball valve 130 depicted may be serrated or otherwise tailored to enhance such cutting of any intervening line.

A responsive automatic triggering closed of the valve 130 within the assembly 100 may be a safety measure. With specific reference to FIG. 2, a broken string 260 in combination with failure to seal off the well 280 may result in the migration of hazardous hydrocarbons through the riser annulus 275. That is, a producing well 280 may send hydrocarbons through the annulus 275 and to the floor 225 of the platform 220 with potentially catastrophic consequences to personnel.

In order to ensure an automatic triggering of valve closure in response to a structural breach of the separation segment 102, the assembly 100 is outfitted with a relay mechanism 114. This mechanism 114 provides real time communication between the separation 102 and valve 150 segments. Thus, upon separation of the separation segment 102, the valve 130 may be sprung closed. More specifically, in one embodiment, valve 130 is of a 'normally closed' variety and the relay mechanism 114 includes a hydraulic pilot line 115 liked thereto (see terminal 107). This line 115 may be configured to forcibly compress an internal spring of the valve 130 so as to keep it in an open state. However, the line 115 may be linked to the separation segment 102 (see terminal 105). Thus, an intentional break in the line 115 at the noted shearing joint 101 may serve as an override so as to allow the valve 130 to rotate to its closed position and seal at the seat 139.

Continuing with reference to FIG. 1, specifically, embodiments herein are configured to trigger forcible cutting in addition to valve closure where separation circumstances as noted above are presented. So, for example, opening and closing of the valve 130 may be routinely directed through a control line running between the valve segment 150 and the platform 220 of FIG. 2. Indeed, the noted hydraulic line 115 may even serve as, or provide linkage to, such control lines during normal operations. As such, the normal opening and closing of the valve 130 may be more easily achieved in terms of tailored control and/or the amount of forces required to achieve such shifting between open and closed states. On the other hand, a different type and degree of closure may be advantageous in the event of breach of the separation segment 102. That is, in such circumstances, the importance of attaining a tailored, less forcible closure is reduced or eliminated. Rather, such concerns give way to safety and the resultant sealing closed of the well 280 and cutting elimination of any potential intervening obstruction, such as the coiled tubing 110 depicted in FIG. 1.

In order to attain forcible cutting by the valve 130 in the event of a separation, the relay mechanism 114 noted above is also linked to a supplemental power segment 120 (see terminal 109). Thus, a detection of separation as described above, may be employed to actuate supplemental power from this segment 120. For example, in one embodiment, the supplemental power segment 120 is an accumulator which may be hydraulically supplied and charged in advance of installation and/or over the course of normal operations. Thus, a hydraulic break in the line 115 in conjunction with the separation may serve to release an automatic actuation of supplemental power to the valve segment 150 via the power segment 120 strategically located below the shear or break of the separation segment 102.

The power sufficient for cutting an intervening access line 110, such as the depicted coiled tubing 110, may be released in the event of separation. That is, during normal operations, valve closure and re-opening may advantageously remain unaffected and unhindered by the available supplemental power. Indeed, in other embodiments, the valve segment 150 may be equipped with a separate cutting device, such as a guillotine mechanism, to obtain sufficient supplemental power as indicated. Thus, where desirable, the supplementally powered cutting function of the segment 150 may be structurally separated from the function of governing fluid access (e.g. via the valve 130). That is to say, embodiments depicted herein, reveal both functions advantageously achieved with the same valve 130. However, such is not necessarily required.

Continuing with reference to FIG. 1, the supplemental power segment 120 may include an internal accumulator as referenced above. In order to ensure adequate accommodation of the channel 155 therethrough, the accumulator may be of a more compact annular variety. Additionally, as indicated, the type of supplemental power provided may be hydrostatic. Further, it may be a spring loaded or a gas piston, perhaps utilizing compressed nitrogen or other enhanced charging features. Similarly, it may be pressure-balanced. Regardless, in one embodiment, normal closure of the valve 130, without supplemental power, may include conventional release of internal spring power as directed from surface (e.g. the platform 220 of FIG. 2). However, upon separation of the segment 102 above the power segment 120, closure may be powered by supplemental hydrostatic power in addition to the smaller amount of spring power.

Returning to more specific reference to FIG. 2, an overview of an embodiment of a subsea oilfield is depicted where the blowout isolation assembly 100 is put to use. As shown, the assembly 100 provides an anchored conduit emerging from the tubular string 260 leading to the offshore platform 220. Thus, as alluded to above, securely controlled access to a cased well 280, traversing a formation 295 below a seabed 290, is provided.

Given that the tubular string 260 is structurally guided through a riser 250, added safety features are provided to prevent migration of hydrocarbons through the riser annulus 275 should there be a structural breakdown of the assembly 100. More specifically, as detailed above, where stresses result in controlled separation of a portion of the assembly 100, automatic action may be taken to prevent the noted migration. Thus, personnel at the floor 225 of the platform 220 may be spared a potentially catastrophic encounter with such an uncontrolled hydrocarbon fluid production.

Continuing with reference to FIG. 2, equipment disposed at the platform may include a supportive derrick 223 for any number of operations. Specifically, a conventional coiled tubing reel 210 and injector 227 are shown driving such an access line downhole. Additionally, a control unit 229 is shown which may serve as an operator interface for directing a variety of applications, including the noted coiled tubing operations or the normal opening and closing of the valve 130 of FIG. 1 as described above.

Figure 3:
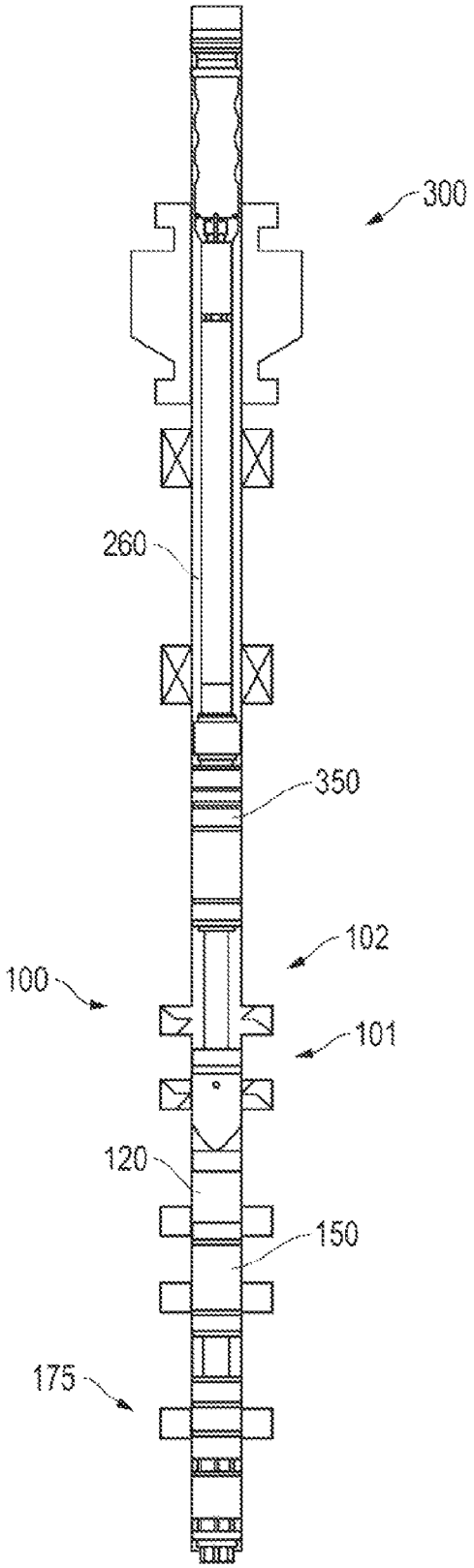
FIG. 3 is a side view of the assembly incorporated into a larger overall landing string.

Referring now to FIG. 3 a side view of the assembly 100 incorporated into the above described string 260 is shown. In this non-schematic view, a more dimensionally realistic depiction of the assembly 100 and segments 150, 120, 102 are shown. At the downhole end, the assembly 100 terminates in the above described coupling 175 with the valve segment 150 disposed thereabove. Additionally, the separation segment 102 is located over the supplemental power segment 120. More specifically, in the embodiment shown, the shearing joint 101 of the separation segment may be of a shearing variety. Regardless, where separation results, supplemental power will be left behind for adequate sealing and/or line cutting by the valve segment 150, whereas the remainder of the string 260 may be released. Thus, subsequent string withdrawal from the riser 250 of FIG. 2 may be readily attained.

Figure 4A:
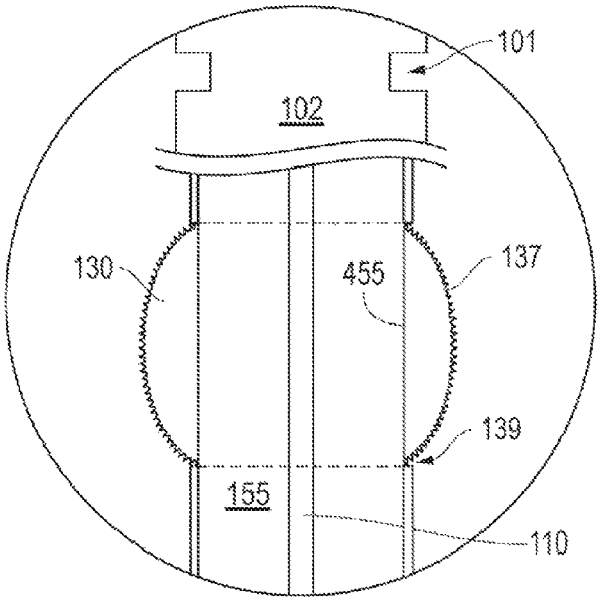
FIG. 4A is an enlarged view of an embodiment of a valve of the isolation assembly in an open position and having an interventional access line therethrough.
Figure 4B:
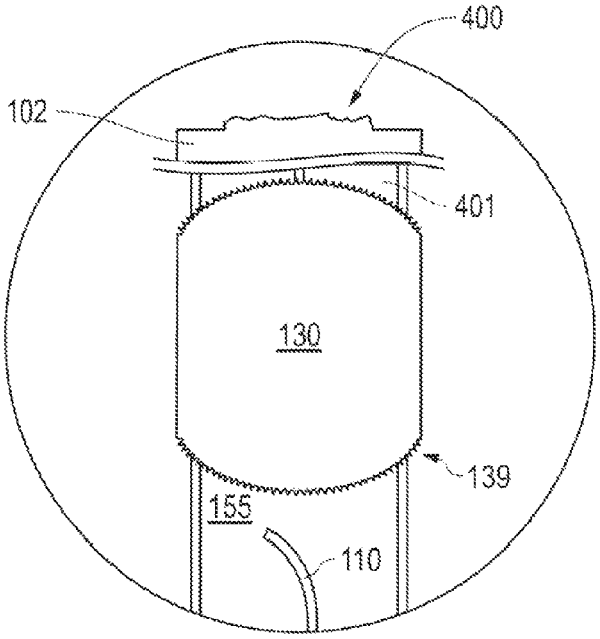
FIG. 4B is an enlarged view of the valve of FIG. 4A in a closed position with the access line cut by the valve.

Referring now to FIGS. 4A and 4B, enlarged schematic views of the assembly 100 are depicted with particular focus on the valve 130 and channel 155 in light of emergency separation as described above. Namely, FIG. 4A highlights these features in advance of such a separation, with coiled tubing 110 running through the channel 155. Of course, recall that wireline and other forms of well access line may similarly be run through the channel 155 depending on the particular nature of operations. Alternatively, FIG. 4B reveals the simultaneous cut of the coiled tubing 110 and sealing at the valve seat 139 in conjunction with a separation 400 of the separation segment 102 thereabove.

With specific reference to FIG. 4A, the valve 130 is shown in an open position with its own internal wall 455 in alignment with the channel 155 so as to allow fluid and interventional access thereacross as indicated by the coiled tubing 110. Thus, normal interventional operations may be underway. However, with added reference to FIG. 4B, stresses may lead to the emergence of a separation 400 at the shearing joint 101 of the separation segment 102. As a result, the valve 130 may be automatically rotated into a sealing position relative the channel 155. This automatic rotation may be achieved with sufficient force and downhole power to simultaneously cut the coiled tubing 110 such that a complete and secure sealing at the valve seat 139 is attained. In other words, the configuration of relay mechanism 114 and supplemental power segment 120 of FIG. 1 may be employed to ensure safe isolation of the well 280 of FIG. 2 where dictated by the emergence of predetermined stress-based conditions on the assembly 100.

Figure 5:
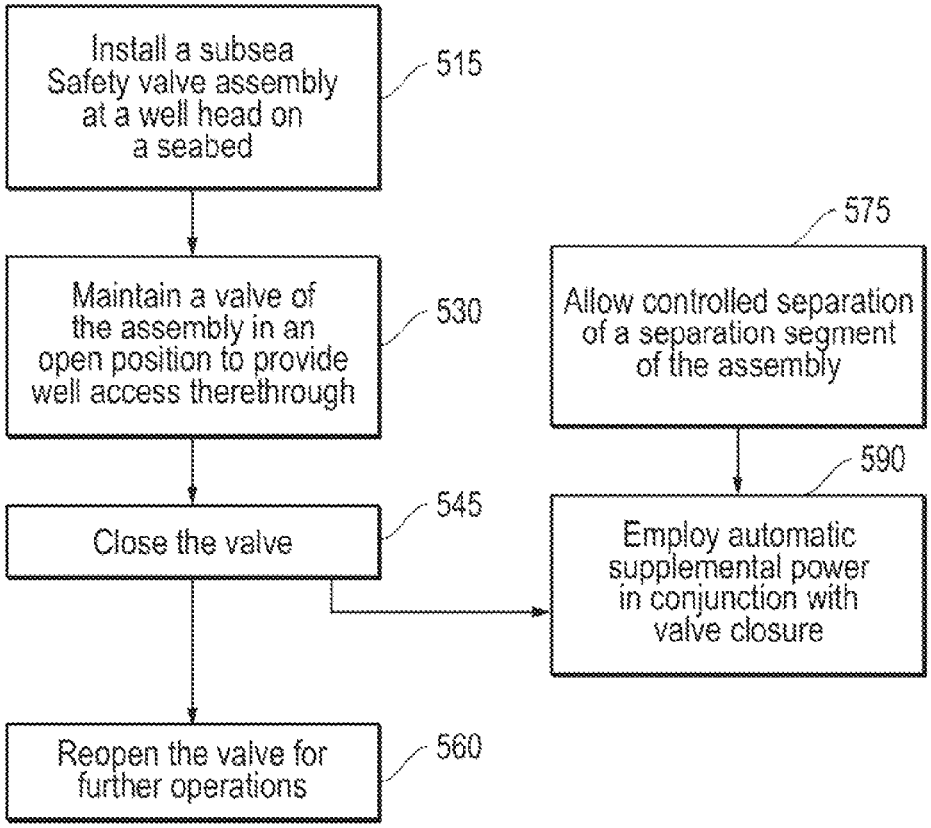
FIG. 5 is a flow-chart summarizing an embodiment of employing a subsea blowout isolation assembly.

FIG. 5 is a flow-chart summarizing an embodiment of employing a subsea blowout isolation or safety valve assembly. Once installed as indicated at 515, the valve of the assembly may be kept open as indicated at 530 as a manner of regulating access to a well therebelow. However, the valve may also be closed as indicated at 545. That is, the valve may be allowed to close over the course of normal operations or, as indicated at 590, supplemental power may automatically be provided to ensure that the valve closes with enough force to cut any intervening access line that might otherwise impair a fully sealed closure. Where the valve is closed as a matter of normal operations, that is, without the added supplemental power, it may be readily reopened, for example to allow for the introduction of well killing or other application fluids.

Embodiments detailed herein provide manners by which a subsea safety valve may be closed with sufficient cut-through force to eliminate any potential obstruction in the form of an access line therethrough. As such, the hazardous uncontrolled migration of hydrocarbons through a surrounding riser and to a rig floor may be avoided. The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. Furthermore, the foregoing description should not be read as pertaining only to the precise structures described and shown in the accompanying drawings, but rather should be read as consistent with and as support for the following claims, which are to have their fullest and fairest scope.

We claim:

1. A safety valve assembly for a separation segment of a landing string for control of a subsea well below an offshore platform, the assembly comprising:

a valve segment positionable below the separation segment and for governing access to the well;

a supplemental power segment positionable below the separation segment to provide supplemental powering upon a triggering of a separation of the separation segment; and a relay mechanism coupled to the separation segment and the supplemental power segment to communicate the separation of the separation segment for triggering the supplemental powering by the supplemental power segment.

2. The assembly of claim 1 wherein said supplemental power segment is coupled to said valve segment to provide the triggered supplemental powering thereto.

3. The assembly of claim 2 further comprising:

a well access line from the platform and through said valve segment; and a valve of said valve segment of capacity to cut said line upon the triggering.

4. The assembly of claim 1 wherein said supplemental power segment comprises an accumulator for the supplemental powering.

5. The assembly of claim 4 wherein the supplemental powering is hydrostatic.

6. The assembly of claim 4 wherein the accumulator is an annular accumulator.

7. The assembly of claim 4 wherein said supplemental power segment further comprises a piston coupled to said accumulator, said piston selected from a group consisting of a spring loaded piston and a gas powered piston.

8. The assembly of claim 7 wherein the gas powered piston is nitrogen-based.

9. The assembly of claim 1 wherein said separation segment comprises a shearing joint for a shear-based separating.

10. The assembly of claim 1 wherein the triggering occurs upon exposure of the landing string to a predetermined load.

11. The assembly of claim 1 wherein said relay mechanism is further coupled to said valve segment and equipment at the platform to allow the governing in absence of the supplemental powering.

12. An offshore well control system comprising:

an offshore platform;

a riser coupled to said platform;

a well head at a seabed coupled to said riser and leading to a well below the seabed;

a tubular running through said riser from said platform to said well head, said tubular terminating in a landing string at said well head;

a safety valve mechanism of the landing string for governing access to the well;

a supplemental power source coupled with the landing string, the supplemental power source being chargeable to provide the safety valve mechanism with a capacity sufficient for cutting a line extending through the safety valve mechanism upon exposure of the landing string to a given condition; and the safety valve mechanism comprising a valve for governing access to the well positioned below a separation segment of the landing string, the supplemental power source also being positioned below the separation segment to provide supplemental powering upon a separation of the separation segment.

13. The system of claim 12 wherein the given condition is a structural separation of said tubular.

14. The system of claim 12 wherein the line is one of coiled tubing and a wireline cable.

15. A method of maintaining well control with an assembly at a subsea well, the method comprising:

opening a safety valve of the assembly to allow access to the well;

closing the safety valve to isolate the well;

monitoring a separation segment of the assembly for emergence of a condition to trigger supplemental power delivery in conjunction with said closing;

providing a supplemental power source to supplement the available power for closing the safety valve; and operatively coupling a mechanism between the separation segment and the supplemental power source to communicate a separation of the separation segment for triggering supplemental powering of the safety valve by the supplemental power source.

16. The method of claim 15 further comprising reopening the safety valve.

17. The method of claim 15 further comprising accessing the well with a well access line prior to said closing.

18. The method of claim 17 wherein the condition is a structural separation of the separation segment.

19. The method of claim 18 wherein said closing comprises cutting the line with the valve.

* * * * *